United States Patent [19]

Suzuki et al.

[11] 4,346,297

[45] Aug. 24, 1982

[54] X-RAY PHOTOGRAPHIC APPARATUS

[75] Inventors: Masakazu Suzuki, Kyoto; Shuhei Furuichi, Shiga; Toshiaki Ikeda, Yahata, all of Japan

[73] Assignee: Kabushiki Kaisha Morita Seisakusho, Kyoto, Japan

[21] Appl. No.: 277,889

[22] Filed: Jun. 26, 1981

[30] Foreign Application Priority Data

Jun. 27, 1980 [JP] Japan ..... 55-88061

[51] Int. Cl.[3] ..... H05G 1/34; H05G 1/58

[52] U.S. Cl. ..... 378/110; 315/107

[58] Field of Search ..... 250/409, 408; 315/107

[56] References Cited

U.S. PATENT DOCUMENTS 4,072,865 2/1978 Craig ..... 250/409

*Primary Examiner*—Alfred E. Smith

*Assistant Examiner*—T. N. Grigsby

*Attorney, Agent, or Firm*—Koda & Androlia

[57] ABSTRACT

The disclosure relates to an X-ray photographic apparatus which can prevent the overshoot of the tube current, which is apt to generate at the start of X-ray radiation. The apparatus comprises an integration capacitor which is charged by the preset preheating level setting voltage during the preheating period, an integration circuit which integrates the difference between the reference voltage and the detection voltage corresponding to the X-ray tube current during the X-ray radiation and a filament heating current control circuit driven by said integration circuit.

3 Claims, 2 Drawing Figures

X-RAY PHOTOGRAPHIC APPARATUS

BACKGROUND OF THE INVENTION

1. Field of the Invention

This invention relates to an X-ray photographic apparatus which is capable of preventing the overshoot of tube current at the start of the X-ray radiation.

2. Prior Art

In the X-ray photographic apparatus of the prior art, the X-ray tube voltage is adjusted to a desired value before photographing to unify the intensity of X-ray to be radiated. However, this adjustment is troublesome, and a commercially available power supply for the X-ray photographic apparatus may frequently fluctuate during the period between the adjustment and photographing. As a result, the fluctuation of the filament current and the tube voltage cannot be prevented, and makes it difficult to radiate X-ray in a uniform intensity.

In another prior art, an X-ray tube voltage supply circuit and an X-ray tube filament driving circuit including a constant voltage transformer, etc. are used to eliminate the necessity for the preset adjustment. However, this approach cannot effectively confront the fluctuation of the X-ray tube current due to the deterioration of the X-ray tube occurring after the use for an extended period and to the variation of environmental temperature.

SUMMARY OF THE INVENTION

Accordingly, it is an object of this invention to provide an X-ray photographic apparatus capable of preventing the overshoot of the tube current at the start of the X-ray radiation.

It is another object of the invention to provide an X-ray photographic apparatus capable of obtaining superior X-ray photographs by unifying the intensity of X-ray to be radiated and by preventing its fluctuation.

These objects are achieved by an X-ray photographic apparatus which includes:

an intergration circuit which comprises an integration capacitor which is charged by preheating level setting voltage during the preheating period, and integrates the voltage difference between the preset reference voltage and the detection voltage corresponding to the tube current in the X-ray tube during the X-ray radiation;

a filament heating current control circuit which drives a filament transformer by the preheating level setting voltage during the preheating period, and also drives the filament transformer by the added voltage of said preheating level setting voltage and the output voltage of said integration circuit during the X-ray radiation.

The construction and advantages of this invention are described in the following Detailed Description of the Invention for easier understanding.

DETAILED DESCRIPTION OF THE INVENTION

Construction

A detailed description will now be given of an embodiment of this invention with reference to the accompanying drawings.

Figure 1:
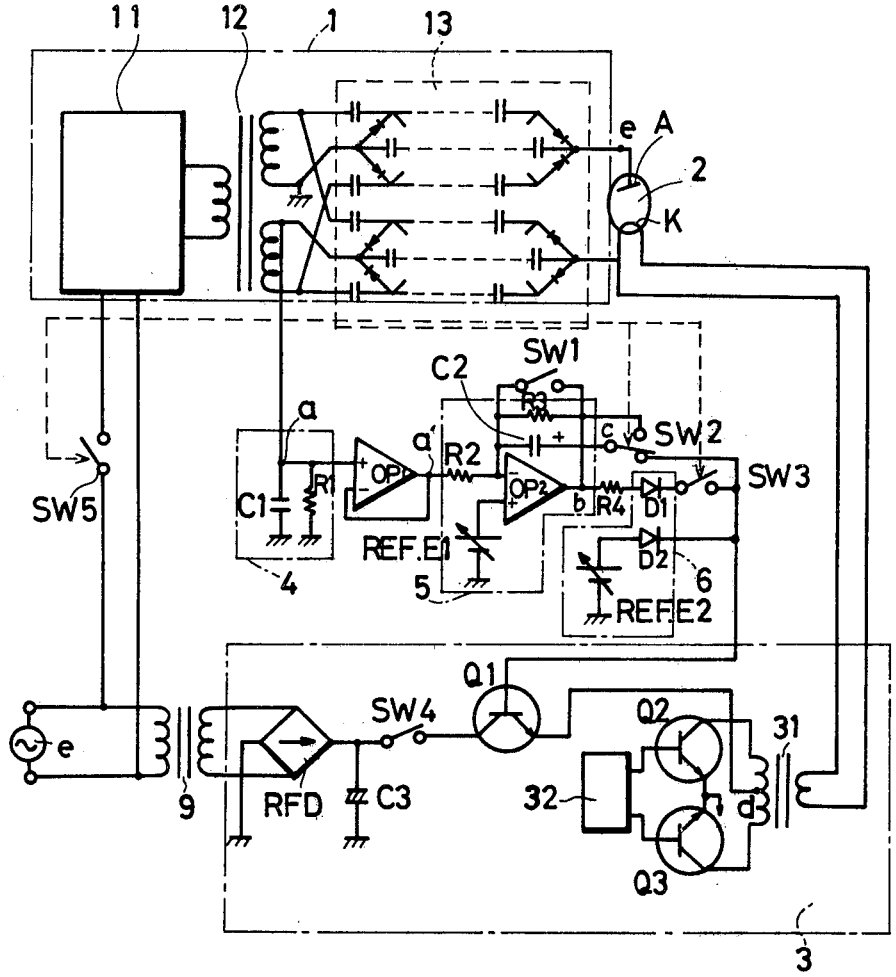
FIG. 1 shows a circuit diagram of the invention.

FIG. 1 shows the electrical circuit diagram of an embodiment of this invention. In the figure, the numeral 1 designates a high-voltage transformation circuit comprising an X-ray tube power supply circuit 11, high-voltage transformer 12 and capacitor-type multiple booster circuit 13. The numeral 2 designates an X-ray tube. The numeral 3 designates a filament current control circuit comprising a control transistor Q1, filament transformer 31 supplying filament heating current to the X-ray tube 2, and a filament transformer driving circuit including transistors Q2 and Q3 and base driving circuit 32 for said transistors. The driving power supply for the high-voltage transformation circuit 1 and filament current control circuit 3 is taken out of the commercially available AC power supply e.

The numeral 4 designates a tube current detection circuit comprising a resistor R1 which detects current through the capacitor-type multiple booster circuit 13 and a capacitor C1 eliminating the ripple component of the detection current.

The numeral 5 designates an integration circuit comprising an operational amplifier OP2 which integrates the voltage difference between the reference voltage Ref. E1 for setting tube current to a desired control value and the tube current detection voltage supplied from the tube current detection circuit 4 through the buffer operation amplifier OP1. The reference character C2 is an integration capacitor connected between the inverting input terminal and the output terminal, as desired by operation of the switch SW2. The resistor R3, connected between the inverting input terminal and the output terminal of the operational amplifier OP2, determines the upper limit of the output voltage of the operational amplifier OP2.

The switch SW1 is equipped between the inverting input terminal and the output terminal of the operational amplifier OP2. When the switch SW1 is turned on, the inverting input terminal and the output terminal are shorted. The resistor R4 and diode D1 connected to the output terminal of the operational amplifier OP2 is further connected to the base of the control transistor Q1 in the filament current control circuit 3, as desired by operation of the switch SW3. Ref. E2, connected to the base of the control transistor Q1, is a preheating level setting voltage slightly lower than the reference voltage Ref. E1, and is applied to the integration capacitor C2 through the diode D2 by the operation of the switch SW2. These switches SW1–SW3 are turned on simultaneously by a relay means (not shown), interlocked with operation of the switch SW5.

The numeral 9 designates a step-down transformer which lowers the voltage of commercially available AC power supply e and supplies the driving power for the control transistor Q1 in the filament current control circuit 3. RFD is a full-wave rectifier, and C3 is a smoothing capacitor.

Operation

A description will now be given of the operating principle of the invention with reference to the drawings.

At the start of photographing by the X-ray photographic apparatus using a thermionit tube, the tube is preheated by the filament heating current before a high voltage is applied to the X-ray tube 2 to prevent the tube from being damaged. The X-ray photographic apparatus of this invention operates as described below during the preheating period and the radiation (photographing) period.

(1) Operation during preheating period

When the switch SW4 is turned on, the preheating level setting voltage Ref. E2 is applied to the base of the control transistor Q1, the control transistor turns on and the filament heating current is supplied to the filament K of the X-ray tube 2. At the same time, the integration capacitor C2 in the integration circuit 5 is charged by the preheating level setting voltage Ref. E2. At this time, however, no voltage is applied between the anode A and the cathode K of the X-ray tube 2, and X-ray is not radiated from the X-ray tube 2.

(2) Operation during radiation

When the X-ray switch SW5 is turned on while the switch SW4 is kept turned on, the X-ray tube power supply circuit 11 is driven and a high voltage is applied between the both pole terminals A and K of the X-ray tube 2. At this time, a relay means (not shown) operates the switches SW1-SW3 simultaneously. The switch SW1 becomes open, the switch SW2 becomes closed to connect the integration capacitor C2 to the resistor R3 in parallel, and the switch SW3 becomes closed. Accordingly, the voltage difference between the reference voltage Ref. E1 and the detection voltage corresponding to the tube current value detected by the tube current detection circuit 4 is integrated by the integration circuit 5 using the preheating level setting voltage Ref. E2 as an initial integration value. The integrated output, represented by the following equation:

$$V_b \doteqdot -(1/C2R2)\int(Va - \text{Ref. El})dt + \text{Ref. E1}$$

is added to the preheating level setting voltage Ref. E2 and supplied to the base of the control transistor Q1. As a result, the filament heating current is fed back and the tube current remains at the constant value set by the reference voltage Ref. E1. With this invention, since the output voltage of the integration circuit 5 maintains the preheating level setting voltage at the beginning, the output voltage increases smoothly without generating overshoot. Therefore, the radiation intensity from the X-ray tube 2 is controlled uniformly from the start.

Figure 2:
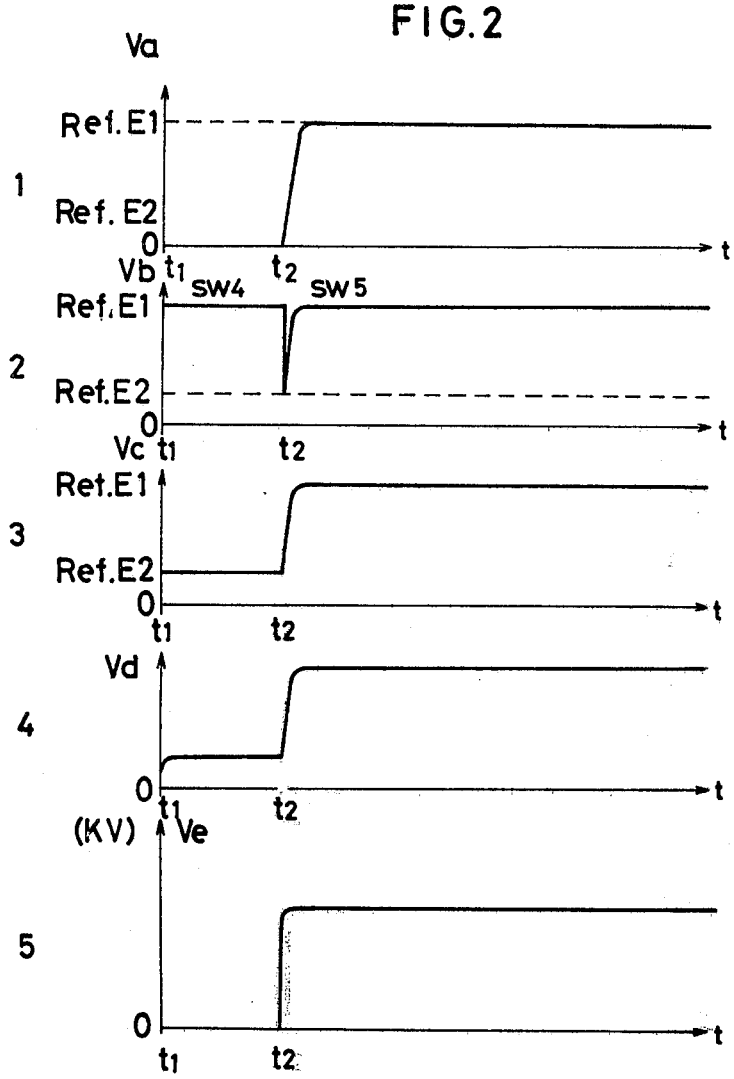
FIG. 2 (1–5) shows operating waveforms at points a–e in FIG. 1.

FIG. 2 shows operating waveforms during said preheating and radiation periods. Va-Ve show operating conditions at the points a–e in FIG. 1. The character $t_1$ indicates the start time of preheating and $t_2$ indicates the start time of radiation.

As described above, since the invention makes it possible to prevent the overshoot of the X-ray tube current, which is apt to generate at the start, and to radiate X-ray in a uniform intensity at all times, this invention is of a great use to obtain superior X-ray photographs without excessive blacking to assure proper diagnosis.

We claim:

1. An X-ray photographic apparatus designed to irradiate X-rays of desired density from an X-ray tube by controlling an X-ray tube current at a desired value set by a reference voltage (Ref. E1) by deriving the X-ray tube current in the form of a detection voltage (Va), integrating the voltage difference between said detection voltage (Va) and said reference voltage (Ref. E1) for setting the desired value of said X-ray tube current, using the integrated voltage as a control signal, and feeding back and controlling a filament heating current, said X-ray photographic apparatus being characterized in that the apparatus has a tube current automatic control circuit (3) for preventing overshooting of the tube current generated at the start of X-ray irradiation by presetting the initial integration value of an integration circuit (5) to a preheating level setting voltage (Ref. E2) lower than said reference voltage (Ref. E1), said integration circuit being designed to integrate the difference between said detection voltage (Va) and said reference voltage (Ref. E1).

2. An apparatus according to claim 1, wherein said integration circuit (5) comprises an integration capacitor (C2) connected to an operational amplifier (OP2), said capacitor (C2) being charged to a preheating level setting voltage (Ref. E2) lower than said reference voltage (Ref. E1).

3. An apparatus according to claim 2 wherein said integration capacitor (C2) is charged by the output of a diode OR circuit, said diode OR circuit having one input connected to the source of preheating level setting voltage (Ref. E2) and a second input connected to the output terminal of said operational amplifier (OP2).

* * * * *